US011572776B2

(12) United States Patent
Johnson et al.

(10) Patent No.: US 11,572,776 B2
(45) **Date of Patent: *Feb. 7, 2023**

(54) HYDRAULIC FRACTURING

(71) Applicant: Shear Frac Group, LLC, Houston, TX (US)

(72) Inventors: Wesley W. Johnson, Spring, TX (US); Danny C. Phillips, Dripping Springs, TX (US)

(73) Assignee: Shea Frac Group, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/826,398

(22) Filed: May 27, 2022

(65) Prior Publication Data

US 2022/0290548 A1 Sep. 15, 2022

Related U.S. Application Data

(63) Continuation of application No. 17/188,728, filed on Mar. 1, 2021, now Pat. No. 11,365,618.

(Continued)

(51) Int. Cl.
*E21B 43/267* (2006.01)
*E21B 49/00* (2006.01)

(52) U.S. Cl.
CPC ..... *E21B 43/267* (2013.01); *E21B 49/006* (2013.01)

(58) Field of Classification Search
None
See application file for complete search history.

(56) References Cited

U.S. PATENT DOCUMENTS 5,377,104 A 12/1994 Sorrells
8,412,500 B2 4/2013 Weng et al.
(Continued)

FOREIGN PATENT DOCUMENTS

EP 1400818 9/2003
WO WO 2017/052529 3/2017
(Continued)

OTHER PUBLICATIONS

Clarkson et al., "Innovative use of rate-transient analysis methods to obtain hydraulic-fracture properties for low-permeability reservoirs exhibiting multiphase flow", University of Calgary, The Leading Edge, vol. 33, dated Oct. 2014, 8 pages.

(Continued)

*Primary Examiner* — Andrew Sue-Ako
(74) *Attorney, Agent, or Firm* — Fish & Richardson P.C.

(57) ABSTRACT

Hydraulic fracturing a subterranean formation with frac fluid, the hydraulic fracturing including complex shear fracturing of the subterranean formation. The technique includes determining an amount of the complex shear fracturing occurring, and adjusting operating parameters of the hydraulic fracturing to increase the complex shear fracturing occurring. The amount may consider fracture surface area. The adjusting may consider resonant frequency of the subterranean formation rock being fractured. The complex shear fracturing may assist with diffusion production. The techniques may include a non-transitory, computer-readable medium having instructions executable by a processor of a computing device to facilitate the aforementioned actions.

20 Claims, 11 Drawing Sheets

Related U.S. Application Data

(60) Provisional application No. 62/983,184, filed on Feb. 28, 2020.

(56) References Cited

U.S. PATENT DOCUMENTS

| | | | | |
|---|---|---|---|---|
| 9,581,004 | B2 | 2/2017 | Ciezobka et al. | |
| 10,711,604 | B2 | 7/2020 | Johnson | |
| 11,313,211 | B2 | 4/2022 | Johnson | |
| 11,365,618 | B2 * | 6/2022 | Johnson | E21B 47/11 |
| 2011/0120712 | A1 | 5/2011 | Todd et al. | |
| 2012/0318500 | A1 | 12/2012 | Urbancic et al. | |
| 2014/0251626 | A1 | 9/2014 | Gomaa et al. | |
| 2015/0032425 | A1 | 1/2015 | Kulkarni et al. | |
| 2015/0075779 | A1 * | 3/2015 | Walters | E21B 43/26 166/308.1 |
| 2015/0101808 | A1 | 4/2015 | Saini et al. | |
| 2016/0047215 | A1 | 2/2016 | Soliman et al. | |
| 2016/0177706 | A1 | 6/2016 | Holland | |
| 2016/0215205 | A1 | 7/2016 | Nguyen et al. | |
| 2019/0145251 | A1 | 5/2019 | Johnson | |
| 2020/0018144 | A1 * | 1/2020 | Haney | E21B 43/305 |
| 2020/0340357 | A1 | 10/2020 | Johnson | |
| 2021/0270116 | A1 | 9/2021 | Johnson et al. | |

FOREIGN PATENT DOCUMENTS

| | | |
|---|---|---|
| WO | WO 2017/074304 | 5/2017 |
| WO | WO 2017/100222 | 6/2017 |

OTHER PUBLICATIONS

Kim et al., "Numerical analysis of fracture propagation during hydraulic fracturing operations in shale gas systems," International Journal of Rock Mechanics & Mining Sciences 76, 127-137, dated Feb. 16, 2015, 11 pages.

McClure, "Characterizing Hydraulic Fracturing with a Tendency for Shear Stimulation Test", University of Texas at Austin, Roland Home, Stanford University. SPE 166332-MS, dated Oct. 2013, 17 pages.

Suarez-Rivera et al., "Optimizing Lateral Landing Depth for Improved Well Production", URTeC: 2460515, dated Aug. 1-3, 2016, 13 pages.

Tary et al., "Interpretation of Resonance Frequencies Recorded During Hydraulic Fracturing Treatments," Journal of Geophysical Research: Solid Earth, Feb. 25, 2014, 119:1295-1315.

Warren et al., "The Behavior of Naturally Fractured Reservoirs", Society of Petroleum Engineers, 245-55, Trans. AIME, 228, dated Sep. 1963, 9 pages.

* cited by examiner

900

Fluid moves through core by diffusion in minutes at Time C.

Time A

Time B

Time C

HYDRAULIC FRACTURING

CROSS-REFERENCE TO RELATED APPLICATIONS

This application is a continuation of and claims the benefit of priority to U.S. patent application Ser. No. 17/188,728, filed on Mar. 1, 2021, which in turn claims the benefit of priority to U.S. Provisional Patent Application Ser. No. 62/983,184, filed on Feb. 28, 2020. The entire contents of each previous application are incorporated by reference herein.

TECHNICAL FIELD

This disclosure relates to hydraulic-fracturing analysis and control.

BACKGROUND

Hydraulic fracturing is generally applied after a borehole is drilled and a cased wellbore formed. Hydraulic fracturing employs fluid and material (e.g., proppant) to create or restore fractures in a geological formation in order to stimulate production from new and existing oil and gas wells. Hydraulic fracturing in the oil and gas industry may increase the flow and recovery of oil and/or gas from a well. Natural gas or crude oil may flow more easily up the well.

Operating wells may be subjected to hydraulic fracturing to remain operating. Fracturing may allow for extended production in older oil and natural gas fields. Hydraulic fracturing may also allow for the recovery of oil and natural gas from formations that geologists once believed were impossible to produce, such as tight shale formations.

Hydraulic fracturing in development of an oil-and-gas well may involve injecting water, proppant, and chemicals under pressure through a wellbore into a geological formation in the Earth crust. Thus, hydraulic fracturing (also called fracing or fracking) is a well-stimulation technique in which rock is fractured by a pressurized liquid. The high-pressure injection of fracing fluid (also labeled as fracking fluid, frac fluid, etc.) into a wellbore generates cracks in the deep-rock formations through which natural gas, petroleum, and brine will flow more freely.

An example fracing fluid is primarily water containing sand or other proppants. In some instances, water and proppant make up 98 to 99.5 percent of the fluid by volume used in hydraulic fracturing. In addition, chemical additives may be incorporated in the water to alter viscosity. The formulation may vary depending on the well. In some examples, the sand or other proppants may be suspended in the water with the aid of viscosity increasing agents. Other chemical additives may be added to the fracing fluid to reduce friction, such as in slickwater. Fracing jobs may direct completion hardware, proppant weights, and water volumes to place sand as proppant in the fractures.

SUMMARY

An aspect of the present techniques relates to a method of hydraulic fracturing a subterranean formation, including injecting frac fluid and proppant through a wellbore into the subterranean formation. The method includes hydraulic fracturing the subterranean formation with the frac fluid. The hydraulic fracturing includes shear fracturing rock in the subterranean formation. The method includes measuring pressure associated with the hydraulic fracturing. The method includes receiving an indicator of an amount of the shear fracturing occurring per unit time. The method includes adjusting operating parameters of the hydraulic fracturing to increase the amount of shear fracturing occurring per unit time. The adjusting of the operating parameters may involve multiple adjustments of an operating parameter over time to goal-seek the shear fracturing to become super shear fracturing.

The details of one or more implementations are set forth in the accompanying drawings and the description below. Other features and advantages will be apparent from the description and drawings, and from the claims.

DETAILED DESCRIPTION

Figure 1:
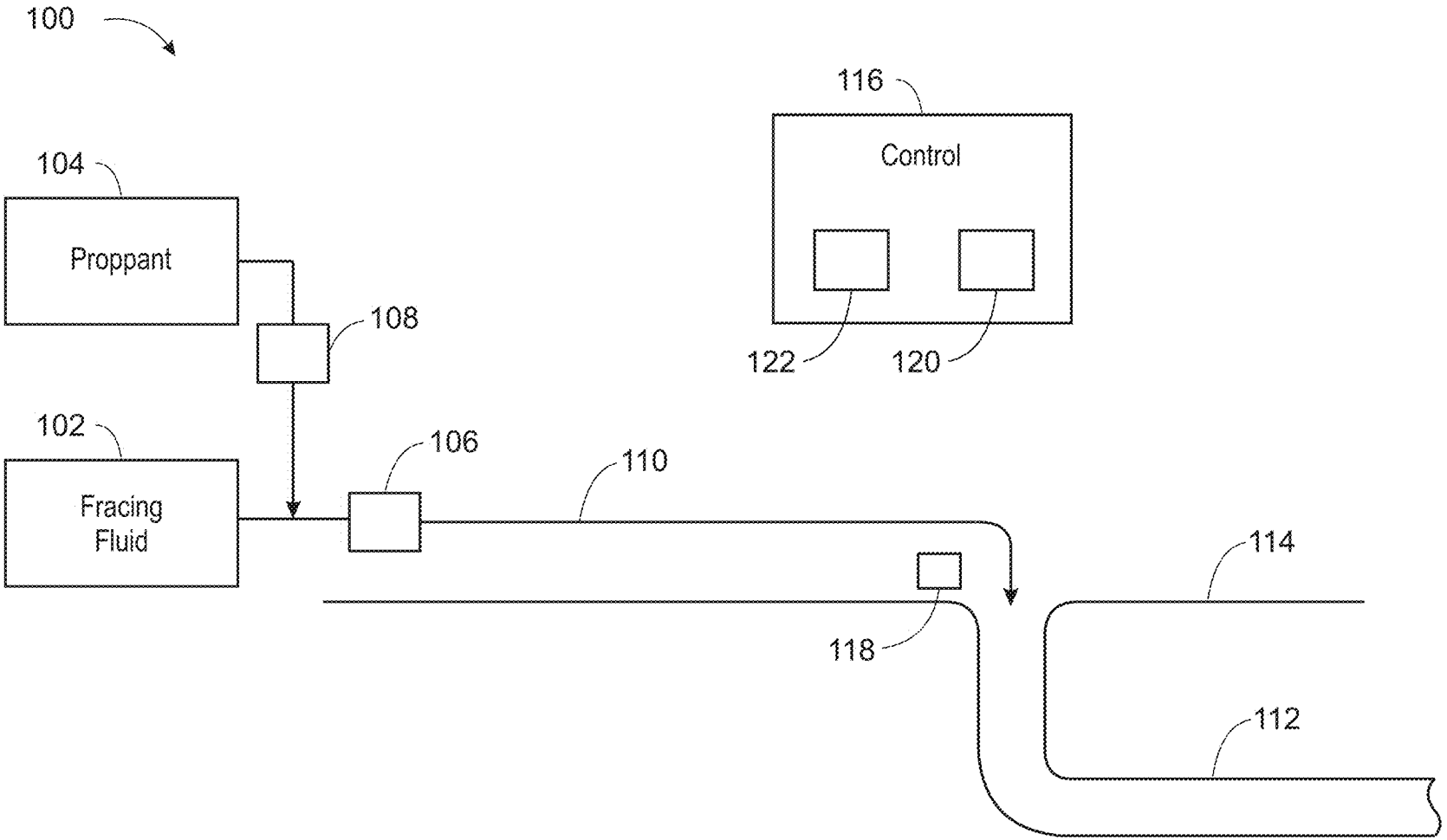
FIG. 1 is a diagram of the real-time fracing process and a well site having a hydraulic fracturing system.

The hydraulic fracturing process, when performed in real time at the surface, may include at least four actions: 1) calibrate slurry rate to match pressure leak-off by adjusting slurry rate to track pressure; 2) adjust slurry proppant concentration to control leak-off so fluid pressure is converted to stress, thereby creating fractures; 3) adjust slurry rates, viscosity and concentrations as rocks change to goal seek (test various scenarios) to trigger (initiate) super (highly destructive) shearing; 4) calculate the surface area (ft^2) during shear fracturing and the permeability (ft^2) during super shearing. Shear fracturing may increase fracture surface area and cause higher well production rates. Shear fracturing (including super shearing) may increase permeability and recovery factors.

Embodiments of the present techniques relate to hydraulic fracturing a subterranean formation to promote complex shear fracturing of the subterranean formation. The hydraulic fracturing includes injecting fracing fluid through a wellbore into the subterranean formation. The fracing fluid may generally have proppant. The fracing fluid as injected may generate stress waves in the rock being fractured to advance the shear fracturing. The fracing fluid may initiate or trigger stress waves that then self-propagate. The presence of the injected proppant in the shear fractures can reduce leak-off of the fracing fluid into the formation and facilitate generation of stress in the rock via the fracing-fluid pressure.

Operating parameters of the hydraulic fracturing may be adjusted in real time to goal seek to reach super shear fracturing. The operating parameters adjusted may include, for example, flow rate of the fracing fluid, concentration (and size) of proppant (e.g., sand or manufactured products) in the fracing fluid, and so on. The occurrence and magnitude of the adjustments in the goal seeking to attain super shear fracturing may take into account (or be in response to) measured variables or determined indicators of the hydraulic fracturing. A measured variable considered may be, for example, the pressure associated with the hydraulic fracturing. The pressure may be measured, for instance, at the wellhead or downhole. A determined (e.g., calculated) indicator that may be received and evaluated can be, for example, an indicator of the amount of shear fracturing that is occurring. The indicator of the amount of shear fracturing may be an indicator of the number of shear fractures per time, surface area of the shear fractures being generated per time, permeability enhancement associated with the shear fractures, permeability or permeability per time, effective permeability generated or effective permeability generated per time, and so forth. Other measured variables and determined indicators are applicable. Permeability or effective permeability may be an indication of the actual measured permeability in subsequent production. Permeability may be have units, for example, of Darcy or micro-Darcy and is generally flow parameter. Flow can also be due to diffusion from the matrix rock into shear fractures or super shear fractures.

In the goal seeking to implement super shear fracturing, the adjustments may be an attempt to "fluidize" the rock layer(s) being subjected to the hydraulic fracturing to increase the amount of shear fracturing. The adjustments may involve an effort for the applied stress waves (that may self-propagate) to realize the resonant frequency of the rock to increase the amount of shear fracturing.

The super shear fracturing may significantly increase fractured surface area and permeability enhancement as compared to typical shear fracturing or planar tensile fracturing. The super shear fracturing may also extend the fracturing into deeper regions of the geological formation from the wellbore. In some instances, the super shear fracturing may reach (connect to) natural fractures or expulsion fractures where hydrocarbon may flow, for example, by diffusion or capillary flow. Diffusion is flow caused by differences in concentration gradient. Other flow (e.g., all other flow) is caused by pressure gradients. In all, the super shear fracturing in comparison to typical shear fracturing or simple tensile fracturing may: (1) increase fractured surface area that may increase hydrocarbon production rate from the geological formation; and (2) connect to natural fractures to give more fractured volume of the formation with enhanced permeability and increased hydrocarbon recovery by diffusion.

Embodiments of the present techniques may relate to hydraulic shear fracturing of a subterranean formation to reach super shear fracturing. Such may involve fluidizing rock and forming resonant stress waves in the rock in the subterranean formation. Techniques that favor complex (shear) fracturing are disclosed in U.S. Pat. No. 10,711,604, which is incorporated herein by reference in its entirety for all purposes. Those techniques favor complex (shear) fracturing over simple (tensile) fracturing, and involve converting pressure to rock stress. Embodiments herein may focus stress waves (e.g., as energy pulses) so that rock is alternately stressed and de-stressed in constructive waves that are additive to rock destruction. Once these stress waves have been generated (initiated or triggered), the stress waves may then be self-propagating with typical input of frac fluid and proppant. Thus, once initiated, the stress waves may self-propagate in implementations. Constructive stress waves can cause rock destruction as the stress waves pass through geological layers of rock. The adjacent layers may be mechanically similar in certain instances. Each rock layer can have a natural harmonic frequency (e.g., unique for that rock layer) that may be realized to trigger (initiate) super shear fracturing. Typically, laminated rocks (e.g., source rock shales) may be beneficial candidates for these techniques. When hydraulic fluid is injected under pressure, the rock can be effectively fluidized (floated). This may or may not be because the pressure is adequate to support enough of the weight of overlying overburden rock such that the rock can expand slightly, and can be because capillary forces increase fluid penetration along geologic planes of weakness, such as bedding planes. Geologic mechanical layers that shear fracture in response to stress waves or pulsed stress waves may be production targets for unconventional reservoir production.

Initially in a hydraulic fracturing job, the flow rate of fracing fluid that can be reasonably accepted into the geological formation can be established to generate shear fractures. The relationship of fracing-fluid flow rate versus the pressure associated with the hydraulic fracturing may be calibrated. The flow rate may account for leak-off of the fracing fluid into the geological formation in the forming of the shear fractures in the formation. Then, proppant (e.g., sand or other material) may be added to the fracing fluid to prevent or reduce leak-off of fracing fluid from the fractures into the formation. The proppant added may be small, such as 100 mesh or smaller (e.g., 140 mesh or 200 mesh), such that the injected proppant may be conveyed toward fracture tips. The presence of the proppant toward the fracture tips may provide resistance to fracing fluid flow (and reduce leak-off) to increase pressure in the fractures (e.g., provide a form of backpressure). The pressure may generate stress in the rock being fractured. The fracing-fluid slurry having the proppant may be introduced through the wellbore into the geological formation to reduce leak off and to convert pressure to stress. In goal seeking to realize super shear fracturing, the fracing-fluid flow rate and proppant concentration may be adjusted to trigger (initiate) shear fracturing or super shear fracturing.

In certain embodiments, super shear fracturing may be defined as the generation of an obvious or significant slope increase in the sum of shear fracturing events. The onset of shear fracturing and how defined or quantified may be related to the rock type and the particular fracing job.

One or more indicators of the shear fracturing may be received, determined, or calculated. The fracture surface areas of the planar tensile fractures and shear fractures may be calculated. The fracture surface area of the shear fractures in the super shear fracturing may be calculated. The permeability enhancement by the super shear fracturing may be calculated. These calculations calibrate the number of fractures to production rates measured at individual stages and stimulated reservoir volume (SRV) measured from post frac pressure decline calculations.

FIG. 1 is a well site having a hydraulic fracturing system 100 that employs a fracing process with fracing slurry having fracing fluid 102 (e.g., slickwater) and proppant 104. The fracing fluid 102 may be held in a vessel(s). The fracing fluid 102 and proppant 104 may be stored in vessels or containers and including on vehicles (e.g., trucks, skids, etc.) in certain examples. In some implementations, the fracing fluid 102 is slick water which may be primarily water, such as 98.5% or more by volume. The fracing fluid 102 can also be gel-based fluids. The fracing fluid 102 can include polymers and surfactants. Other common additives may include hydrochloric acid, friction reducers, emulsion breakers, emulsifiers, and do on. At the well site, the proppant 104 can be provided from multiple railcars, hoppers, containers, or bins of proppant of differing mesh size (particle size).

The system 100 includes control devices 106 and 108 for the fracing fluid 102 and the proppant 104, respectively to prosecute the fracing process that are actions to realize shear and super shear fracturing. The control device 106 may include pumps as motive devices (and also as metering devices in some examples). The control device 106 for the fracing fluid 102 may also include a control valve in certain examples. The pumps may be, for example, positive displacement and arranged in series and/or parallel. In some examples, the speed of the pumps may be controlled to give desired flow rate of the fracing fluid 102. The proppant control device 108 may include, for example, a blender, feeder (e.g., rotary feeder, etc.), conveying belt, metering device, and so on. A blender, for example, may be a solid blender that blends proppant 104 of different mesh size. The proppant 104 may be added (e.g., via gravity) to a conduit conveying the fracing fluid 102 such as at a suction of a fracing fluid pump (e.g., of 106) to give a stream 110 that enters the wellbore 112 for the hydraulic fracturing. Thus, the stream 110 may be a slurry that is a combination of the fracing fluid 102 and proppant 104. The stream 110 may be labeled as fracing fluid or as fracing fluid having proppant. For instances when proppant 104 is not added to the fracing fluid 102, the stream 110 entering the wellbore 112 for the hydraulic fracturing may be the fracing fluid 102 without proppant 104.

The wellbore 112 may be formed through the Earth surface 114 into a geological formation in the Earth's crust. The source of fracing fluid 102 and the source of proppant 104 may be disposed at the Earth surface 114. The wellbore 112 may be vertical, horizontal, or deviated. The wellbore 112 may be a cemented cased wellbore and have perforations for the stream 110 to flow (injected) into the formation. Balls that seat in the well, or other techniques, may also be utilized to control the fracing (fracturing) process.

The hydraulic fracturing system 100 may include a control system 116 to direct operation of the hydraulic fracturing system. The fracturing system 100 generally includes gauges or sensors to measure different operating parameters. For example, the system 100 may include a pressure sensor 118 disposed at a wellhead (not shown) of the wellbore, or in the subsurface of the wellbore 112 to measure the wellhead and/or bottom pressure during the hydraulic fracturing. In some implementations, the control system 116 may receive the measured pressure data and may also consider the wellhead pressure as the treating pressure of the hydraulic fracturing. The control system 116 may include a computing system to implement techniques described herein associated with analysis and control. The computing device may be disposed within the control system 116. The computing device may instead be a field computer or remote. The control system 116 may include one or more controllers. The control system 116 (and the computing device) can include a processor(s) 120, such as a central processing unit (CPU) or microprocessor, or cloud based computing system. The control system 116 (and the computing device) can include memory 122 storing code (e.g., logics, instructions, etc.) executed by the processor 120. The memory 122 may include volatile memory, such as random access memory (RAM), cache, cloud computing, etc. The memory 122 can include nonvolatile memory, such as a hard drive, read only memory (ROM), solid state drives, or cloud servers, etc.

Hydraulic fracturing may create new fractures in the rock in the geological formation, as well as increase the size, extent, and connectivity of existing fractures and bedding planes in the geological formation. The producing formation is fractured open via hydraulic pressure. Then, proppants 104 (propping agents) are pumped into the oil well with fracing fluid 102 to hold the fractures or fissures open so that energy (pressure) can be applied (e.g., via pumped fracing fluid) into the formation and converted to stress to enhance the breaking of the rock. Hydraulic fracturing is generally employed in low-permeability rocks, such as tight sandstone, shale, and some coal beds, to increase crude oil or gas flow to a well from petroleum-bearing rock formations. A beneficial application may be horizontal wellbores in low-permeability geological formations having hydrocarbons, such as natural gas, crude oil, etc. Massive hydraulic fracturing or high-volume hydraulic fracturing may be applied to gas or oil-saturated formations with low permeability (e.g., less than 0.1 millidarcy) and often in the nanodarcy range (e.g., less than 1 microdarcy) of permeability. At very low permeability, such as less than 1 microdarcy or less than 0.1 microdarcy, diffusion production may become more important or more significant contribution.

Some hydraulic fracturing generally accepts whatever fracture types develop. In contrast, embodiments herein generate hydraulic fractures possible by measuring the harmonic frequency of geo-mechanical layers and adjusting hydraulic fracing parameters (operating variables) to create constructive interference. A measure of stress waves may classify different degrees of shear fracturing. Embodiments may measure or reach the natural harmonic frequency of different geologic layers. Increased shear fracturing may be realized at this frequency giving significantly increased rock destruction. Stress patterns may identify shear fracturing by the length of time (period) to initiate and propagate each type of fracturing (e.g., shear fracturing versus planar tensile fracturing). The fracing slurry flow rate and proppant concentration of sand-fluid slurries may be adjusted to trigger the onset of significant shear fracturing (e.g., including laminated-rock shear fracturing) for each stage having particular geo-mechanical layer(s). The number of shear fractures or extent of shear fracturing may be counted or determined in each hydraulic-fracturing stage to select rock for completion and production.

The current present techniques may provide for real-time (second-by-second) control of types of fractures that form to create increase fracture surface-area and well productivity. The techniques may account for efficient utilization of injected water and sand. Hydrocarbon recovery may be increased, well spacing may be improved, field developments may be focused in the desired pay zones, and reduced well declines may be achieved with diffusion production.

Initially for a fracing job, the techniques may generally identify the type of rock to be fractured in each stage. The rock may be classified by a combination of stratigraphic and mechanical bedding, such as massive, laminated, expulsion fractured, etc. The block size may also be considered, as discussed below. The techniques may involve designing the completion for working proppant concentration, which will convert pressure (energy) to stress. The techniques may including actions such as to: (1) fluidize rock by adjusting fluid rates and resulting pressure changes in real time; (2) increase fluid rates to increase stress and observed pressure; and (3) decrease fluid rates to cause rock failure and decrease pressure. Embodiments may guide the separation of measured and guidance pressures in real time including to cause pressure curves to drift together upward (increasing stress) or drift apart downward (increased fracturing). The guidance pressure may be determined or defined as a calculated pressure that is computed by equations or artificial intelligence, from a nearby stage with treating pressure measured in similar rock, proppant, and fluids. Or by utilizing advanced deep learning neural nets with Bayesian statistics that display statistical uncertainty through real time (second-by-second) or delayed time, in fracturing stages.

Fracture systems may be dilated with fluid that is laden with proppant in balanced systems. Relatively small adjustments in fluid rate may allow fractures to grow. Relatively small adjustments in fluid rate may more effectively facilitate fractures to fill with proppant. Generally, no two fracture systems are the same and thus design or models of optimal completions may be problematic. To compensate for ever changing fracture systems, fractures may be measured and classified as shear or tensile and can be counted, e.g., within 15-20 seconds or less from the time they are formed. This may facilitate frac engineers to focus on increase or decrease in fracing fluid rates, proppant concentration in the fracing fluid, proppant size, and fluid viscosity accordingly. Once the rock being fractured is effectively fluidized (floated) because pressure is high enough to penetrate rock, stress waves within the rock volume may become self-propagating. It is observed that frac fluid penetrates rock at pressures below those needed to lift overburden rock.

Stress waves exhibit different frequencies which can be measured and stimulated to be additive for triggering wave trains that may extend for tens or thousands of seconds. The amount of shear fracturing can be defined as shear fracturing or super shear fracturing.

Figure 2:
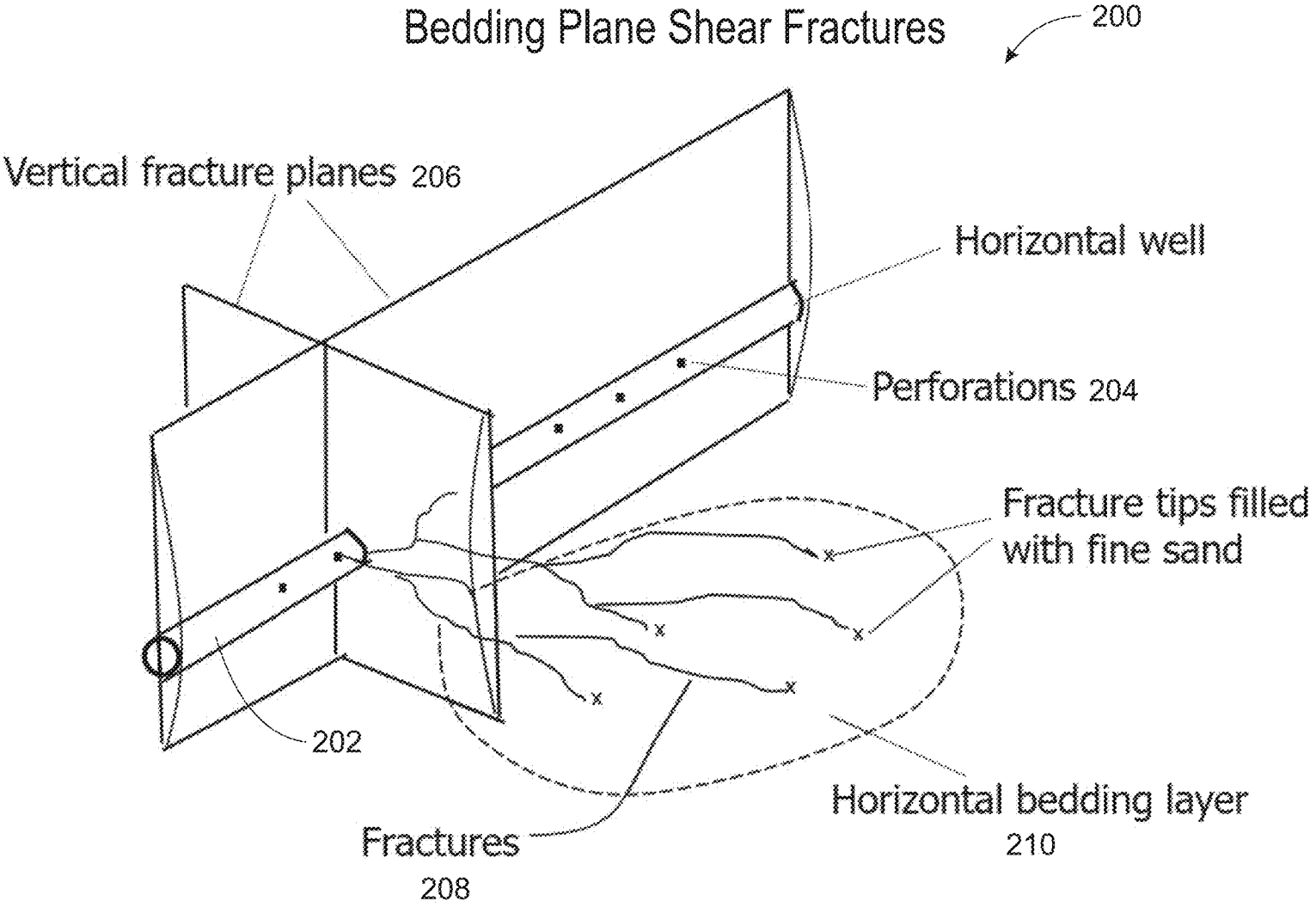
FIG. 2 is a diagram of a geological formation having fractures around a wellbore.

FIG. 2 is a geological formation 200 having fractures around a wellbore 202. Fractures may begin vertical along, or perpendicular to wells. The fractures may grow in exiting fractures within bedding layers. The wellbore 202 may have perforations 204 for injection of fracing fluid into the geological formation 200. In the illustrated embodiment, the wellbore 202 is a horizontal wellbore. The fractures may include fractures along vertical (or near vertical) fracture planes 206 with respect to the wellbore 202. The vertical planes 206 may include a vertical plane (or near vertical plane) that is generally perpendicular to the longitudinal length of the wellbore 202 and may include a vertical plane that is parallel (in-line) with the longitudinal length of the wellbore 202. In other words, the fractures may begin vertical perpendicular to the wellbore 202 and also may begin vertical along the wellbore 202. The fractures may grow into existing fractures within bedding layers. These fractures 208 (shear fractures and/or connected existing fractures) may be in a horizontal bedding layer(s) 210. The fracture tips of the fractures 208 (or a portion of each fracture 208 toward or near the fracture tip) may receive proppant. The proppant may be fine sand or other material (e.g., generally 100 mesh or less) so that the proppant may reach further into the fractures 208.

Figure 3:
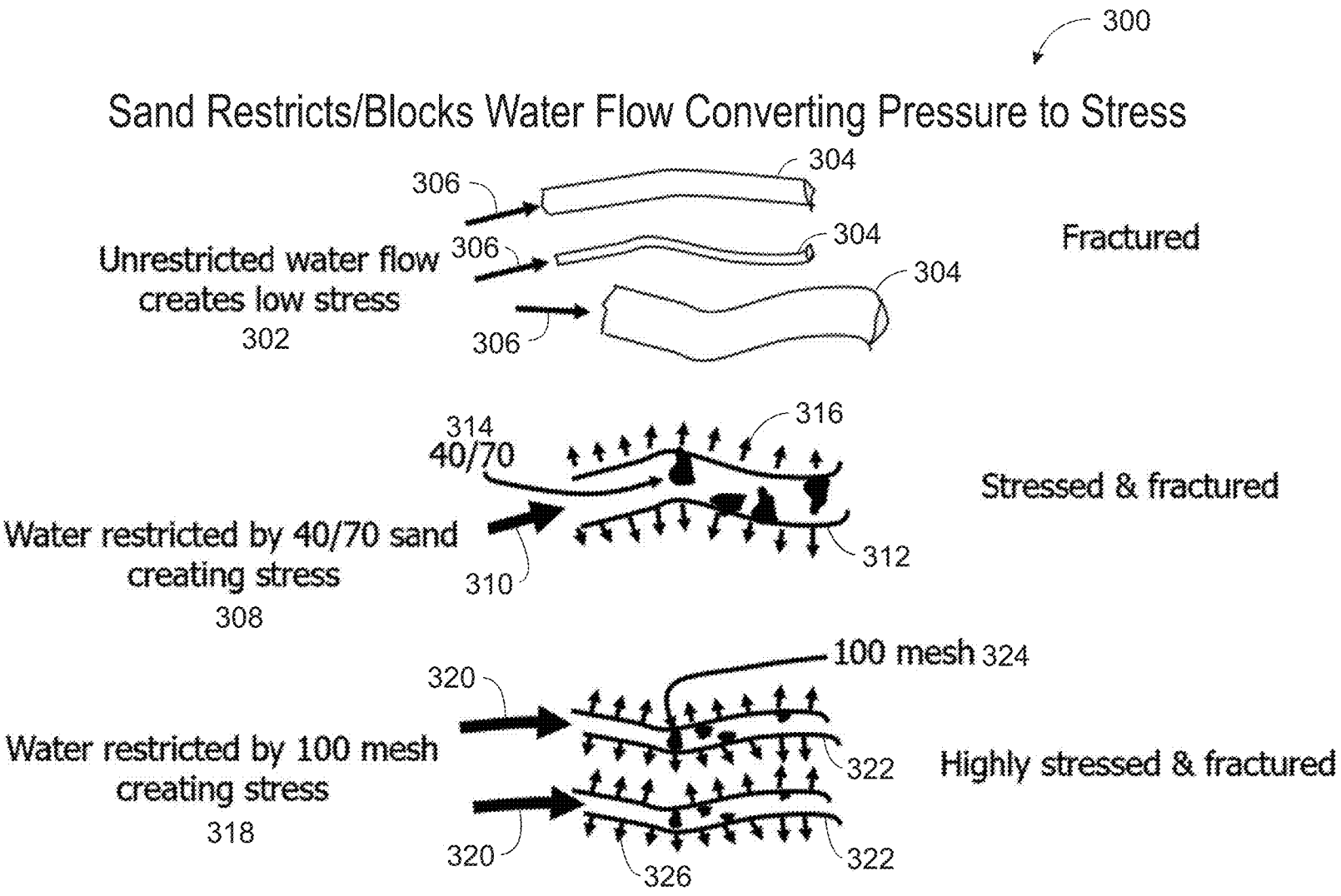
FIG. 3 are representations associated with fracing-fluid liquid flow through fractures and with the presence (or lack thereof) of proppant.

FIG. 3 are representations 300 associated with fracing-fluid liquid flow through fractures and the presence (or lack thereof) of proppant (and proppant size). Small fractures are generally closer together and stress rock more than larger fractures. There are typically many more small fractures than large fractures. The liquid in the fracing fluid may be primarily water. The diagrammatical representation 302 is for flow 306 of the fracing-fluid liquid through fractures 304 with no proppant. Therefore, water (liquid) flow is generally unrestricted (there may be low restriction due to lack of proppant limiting fluid flow) and thus lower stress is generated. The rock can be characterized as not efficiently fractured.

The representation 308 is for flow 310 of fracing fluid through fractures 312 with 40/70 mesh proppant 314. The water (liquid) flow is restricted by the proppant 314 and therefore stress 316 is generated on the rock being fractured. The rock can be characterized as somewhat stressed and not optimally fractured because fluid can generally leak through 40/70 and coarser sands more easily than 100 mesh and smaller particle sand and smaller proppants.

The representation 318 is for flow 320 of fracing fluid through fractures 322 with 100 mesh and smaller proppant 324. The water (liquid) flow is restricted by the proppant 324 and therefore optimal or beneficial (increased and decreased) stress 326 is generated in the rock being fractured. The rock may be characterized as highly stressed and highly fractured in some examples. In other words, the smaller 100 mesh (or finer) proppant 324 may be able penetrate further into the fractures than the 40/70 mesh (or larger) proppant. In certain instances, the smaller 100 mesh (or even smaller mesh) proppant 324 can also give a more densely fractured formation, with more fractures per barrel of water.

The small fractures 322 are closer together than larger fractures and may generally stress the rock more than large fractures farther apart. There may be a much greater amount of small shear fractures than large shear or tensile fractures, making better connections to natural expulsion fractures caused by oil or gas expansion.

Figure 4:
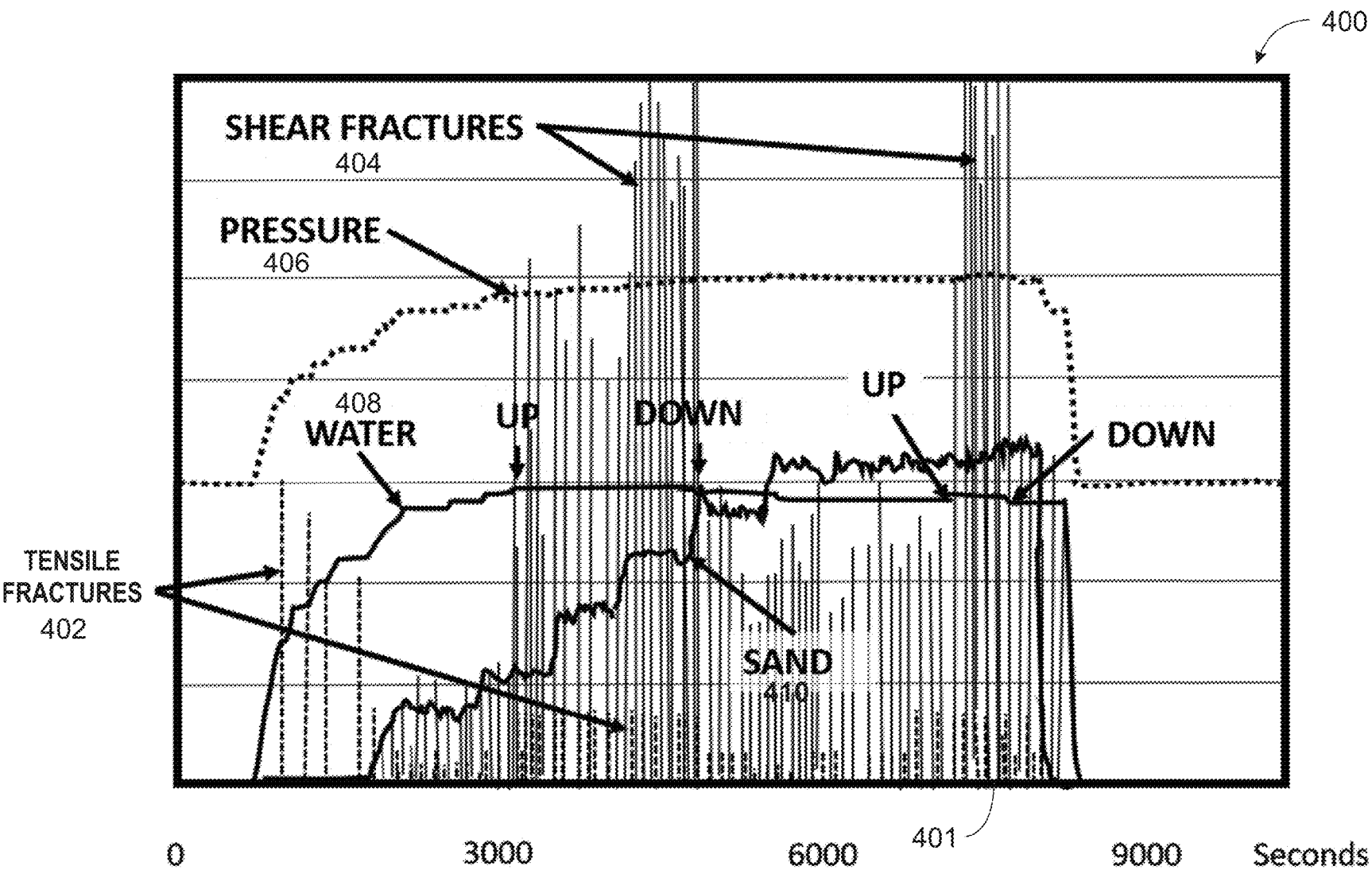
FIG. 4 is a plot of an exemplary depiction of certain variables of the present hydraulic fracturing over time.

FIG. 4 is a plot 400 of exemplary depiction of certain variables of the present hydraulic fracturing over time 401 (seconds). Real-time adjustments are made to frac fluid (water) rate and proppant (sand) size/concentration. Small changes in frac fluid rate or sand size/concentration can sometimes dramatically affect shearing.

Indications of the amount (e.g., number or count, surface area, etc.) per time 401 of both tensile fractures 402 and shear fractures 404 are given in plot 400. The indicator (curve) of shear fractures 404 may be the fracture count of shear fractures per time (e.g., per second). The indicator may be the fracture surface area generated through time. The indicator may also include or account for added permeability (or increased recovery) due to super shear fracturing and concentration gradient (diffusion) production.

Embodiments may receive the indicator of shear fractures 404 and make adjustments to operating variables accordingly. Multiple implementations for determining an indicator of shear fractures 404 are applicable. The determination of the indicator may be based on pressure associated with the hydraulic fracturing. The determination of the indicator (of shear fractures 406 per time) may be based, for instance, on a regression or neural network that weights fracing-fluid flow rate, proppant concentration, fracing fluid properties (e.g., viscosity), rock properties, and other factors. In some instances, the shear-fracture surface area may be characterized as the area under the sum of curve 406. In implementations, the determination of the indicator may be based on pressure derivatives of the hydraulic fracturing, and so on. The determination or calculation may be performed with neural networks, machine learning, artificial intelligence, or computer code with equations, or any combinations thereof. The indicator may be based on ease at which the proppant is placed in the complex shear fractures at lower rates than to place proppant in tensile fractures, the increased productivity of shear fractured wells, and observed requirement for less water to place the same amount of proppant in fracture systems with greater surface area. The indicator may have units of number of fractures or area (e.g., square feet).

The pressure 406 (e.g., in pounds per square inch gauge or psig) associated with the hydraulic fracturing is plotted over the time 401. The pressure 406 may be wellhead pressure, downhole pressure, a calculated pressure (e.g., correlative with hydraulics), or some combination thereof. The water 408 curve is the flow rate of the fracing fluid. The units of the flow rate can be, for example, barrels per minute (bpm), cubic meters per minute, or gallons per minute (gpm). The liquid in the fracing fluid may be primarily water (e.g., greater than 98% by volume) and therefore the simplified label of "water." The water 408 curve may be a slurry rate (total flow rate of the fracing fluid having both liquid and solids) when proppant is added to the fracing fluid.

Lastly, the sand/proppant concentration 410 (e.g., weight percent or volume percent) in the fracing fluid is plotted. The proppant may be, for example, 40/70 mesh or smaller, 100 mesh or smaller, or 200 mesh. In some examples, the proppant concentration 410 may be based on the flow rate of fracing fluid and the addition rate of the proppant. In other examples, the proppant concentration 410 may be indicated based on density of the fracing fluid.

As indicated by the plot 400, real-time adjustments may be made to the fracing fluid flow rate 408 and to the proppant concentration 410. Relatively small changes in fracing-fluid flow rate and proppant concentration can significantly affect the amount of shear fracturing that occurs.

The fracing fluid may generally have proppant (e.g., proppant at 40/70 mesh, 100 mesh, or 200 mesh) that is conveyed to the shear fractures. The presence of the proppant in the shear fractures may reduce leak-off of the injected fracing fluid through the shear fractures into the geological formation and thus facilitate conversion of pressure to stress.

Figure 5:
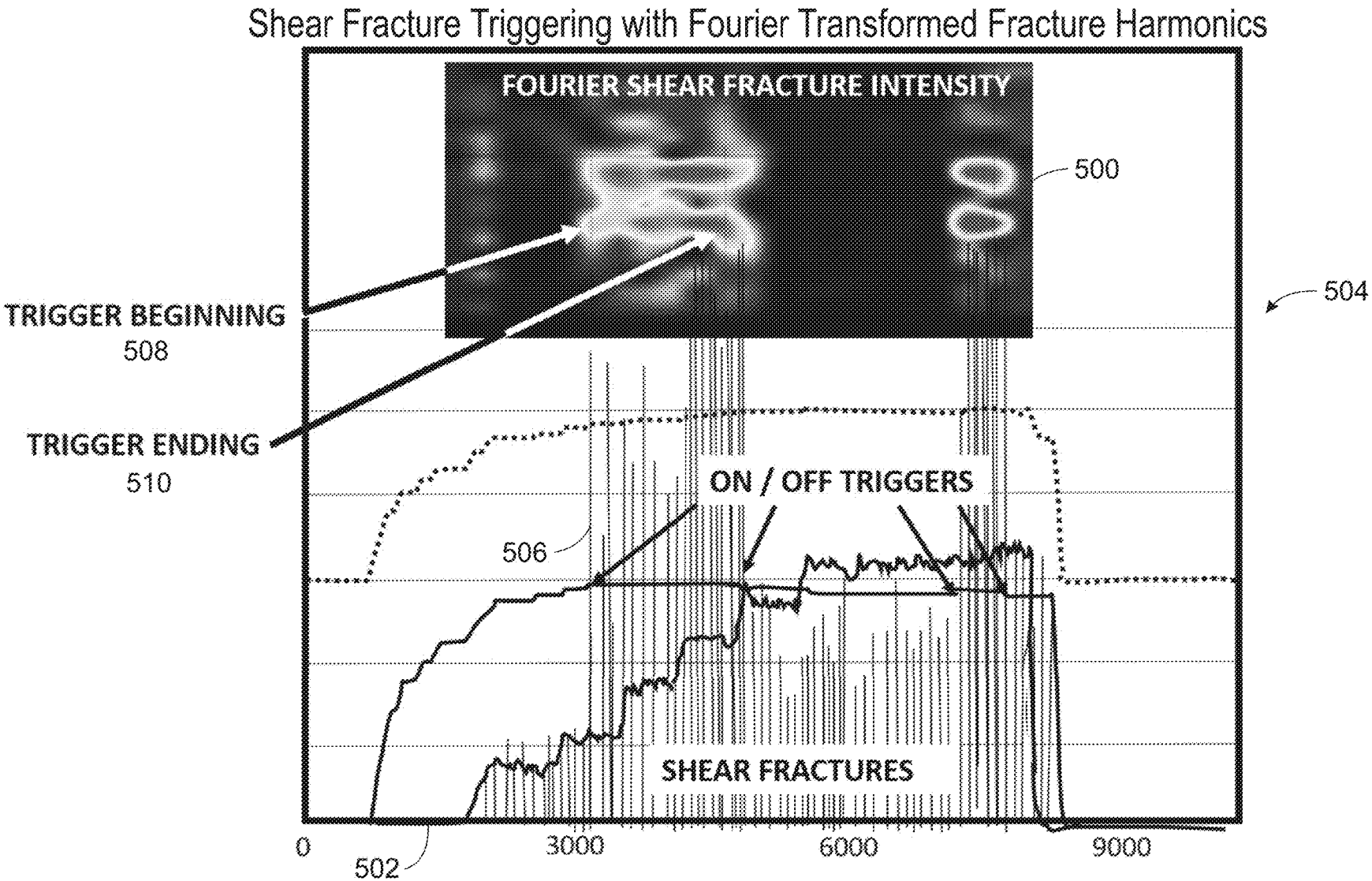
FIG. 5 is an output image of Fourier Transformed fracture harmonics over time.

FIG. 5 is an output image 500 of Fourier Transformed fractured harmonics over time 502. The image 500 is embedded on a plot 504 over time 502 of hydraulic-fracturing variables including an indicator 506 of the amount of shear fracturing per unit time. A trigger is indicated as beginning 508 and ending 510.

Figure 6:
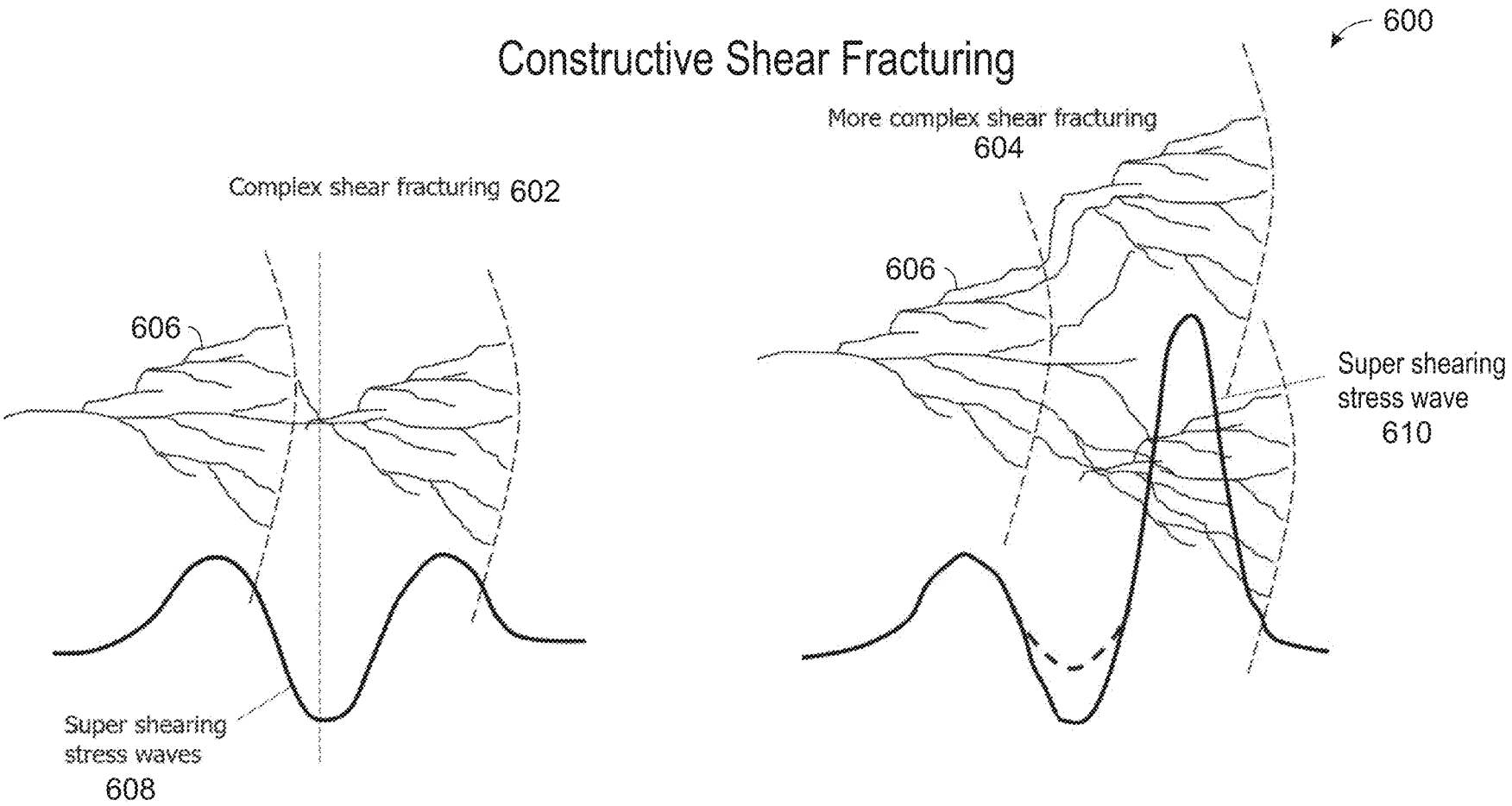
FIG. 6 are diagrammatical representations of shear fracturing and super shear fracturing.

FIG. 6 are diagrammatical representations 600 of shear fracturing 602 and super shear fracturing 604. The dendritic growth for the fractures 606 is greater for the super shear fracturing 604 than the shear fracturing 602. Shearing stress waves 608, 610 are applied and realized in the rock being fractured.

Figure 7:
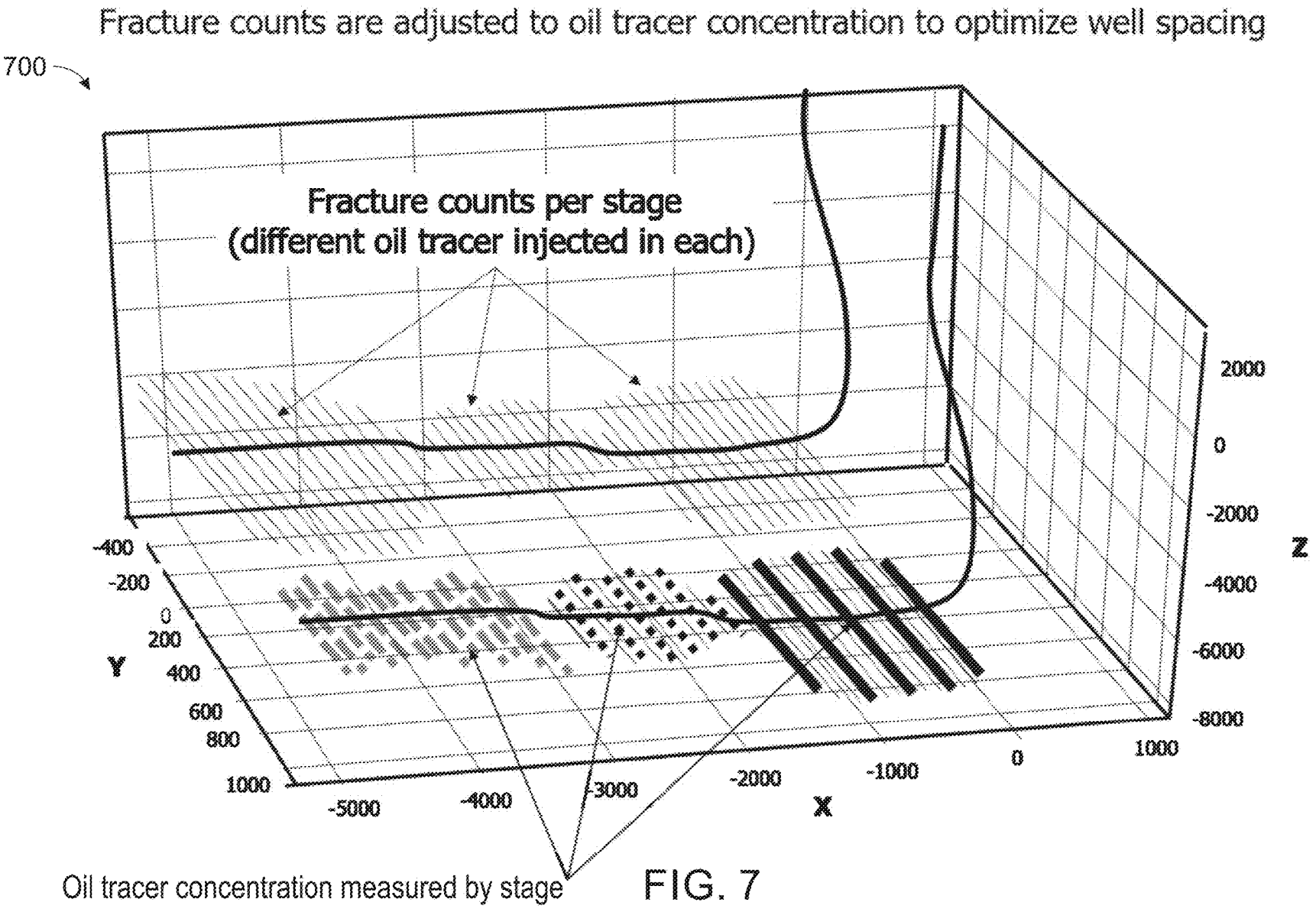
FIG. 7 is a three-dimensional plot showing different fracture counts and tracer distances from wells, as fractures vary by geologic layer.

FIG. 7 is a three-dimensional plot 700. The X axis is distance along the wells measured in feet. The Y axis is distance in front of and behind the wells in feet. The Z axis is the true vertical depth below sea level. The plot 700 indicates that fracture counts of the shear fracturing are adjusted to oil tracer concentration to provide beneficial well spacing. Depicted in the plot 700 are fracture counts (lines) per stage and the approximate distances hydraulic fractures extend from the wells. A different oil tracer is injected in each stage. Also depicted is oil tracer concentration measured by stage (with different line types).

Figure 8:
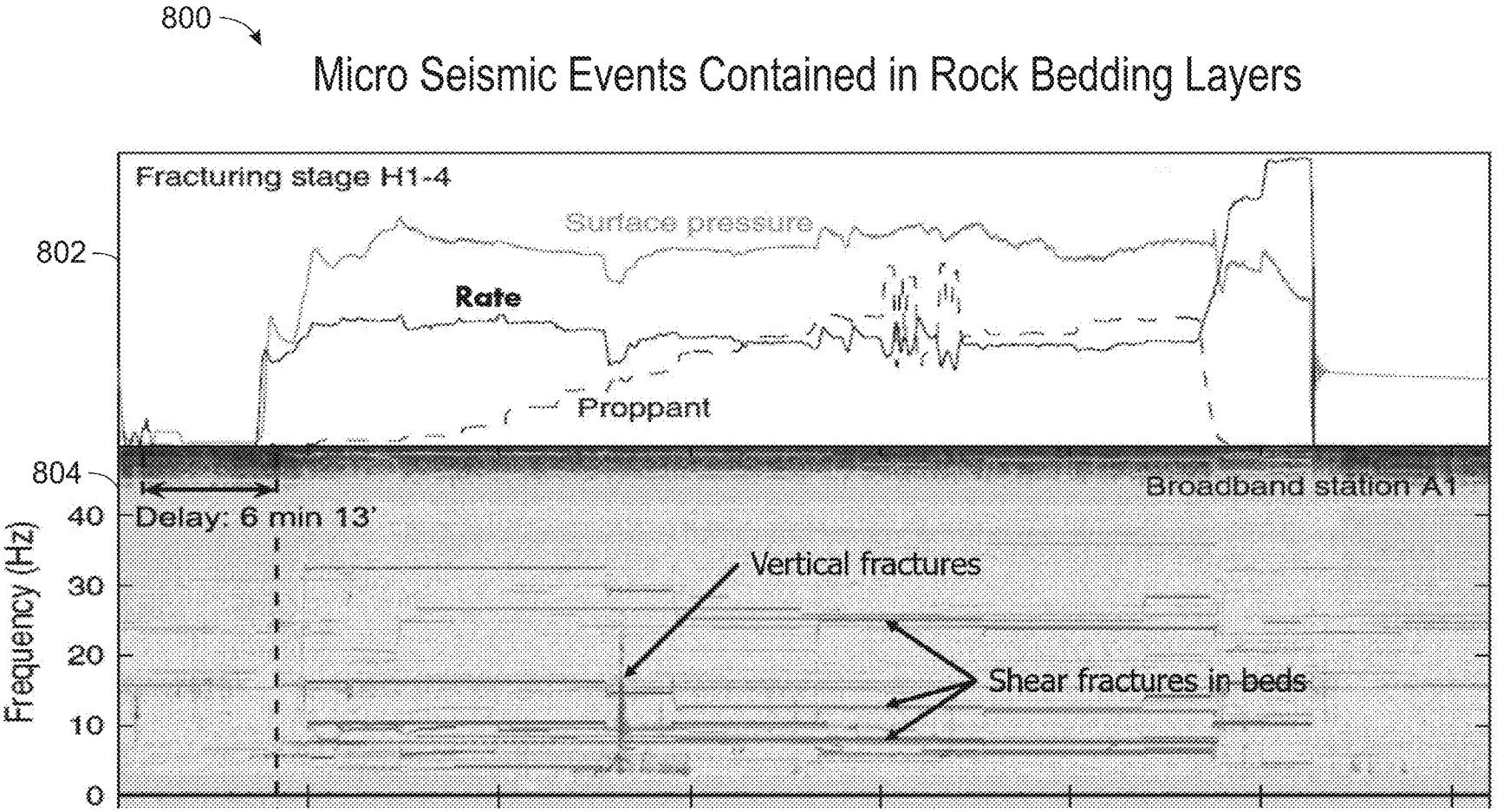
FIG. 8 is a diagrammatical representation of micro seismic events contained in rock bedding layers during hydraulic fracturing.

FIG. 8 is a diagrammatical representation 800 of micro seismic events contained in rock bedding layers during hydraulic fracturing. Micro seismic events are typically in clusters. Dark shading indicates the most events.

Beds have many shear fractures. There are only a few tensile (vertical) fractures observed. The plot 802 gives over time the surface pressure, fracing-fluid flow rate, and fracing-fluid proppant concentration for a fracturing stage. The image 804 is the frequency (hertz) of the fractures over the same time scale as the plot 802. The micro seismic events may occur in layers with common frequency caused by similar rock breaking frequency. Dark shades indicate few fracturing events. Lighter shades indicate large numbers of micro seismic events. The Y scale on the lower portion of plot 804 is frequency in hertz (Hz) and not necessarily matched to depth for this example.

Figure 9:
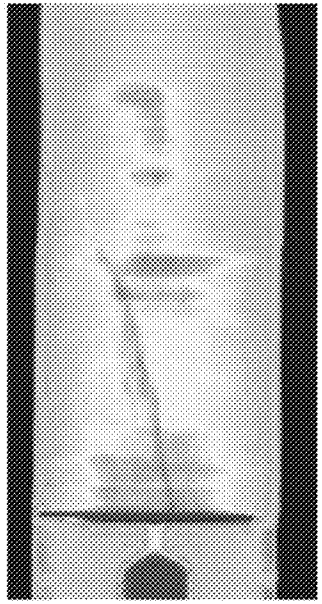
FIG. 9 are images depicting diffusion fluid behavior in fractured rock over a time sequence.
Figure 9:
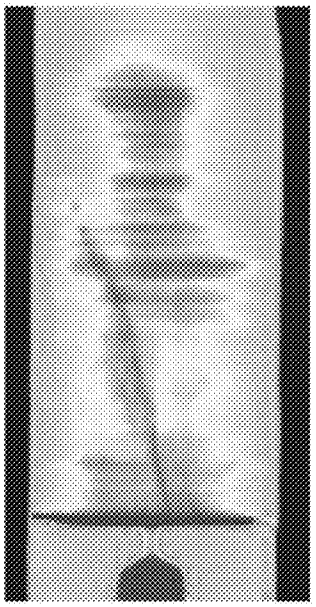
Figure 9:
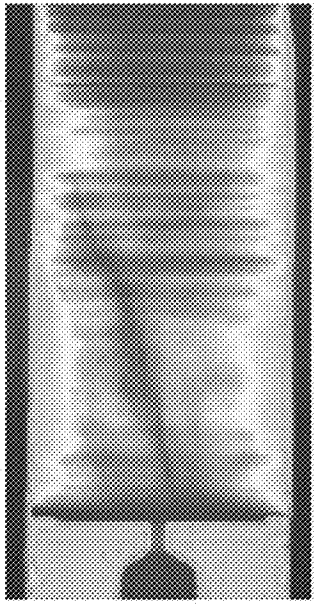

FIG. 9 are images 900 that depict diffusion fluid flow behavior in fractured rock over a time sequence of Time A, Time B, and Time C. Fluid moves through core by diffusion in minutes at Time C. Fluid saturation through core in fractures took about 1 hour at Time A. Diffusion can be a major production mechanism. Fluid saturation (concentration gradients) were measured via neutron tomography tracks water saturation (darker shading in center) advancing through core in fractures and rock layers. Water began filling at Time A and filled the rock sample completely at Time C. This filling process took about one hour. After fluid saturation at Time C, fluids moved from top to bottom in the rock sample by diffusion in about one minute. As an analogy, diffusion is what exchanges oxygen and carbon dioxide in lungs. Diffusion can be very rapid and efficient once established.

Figure 10:
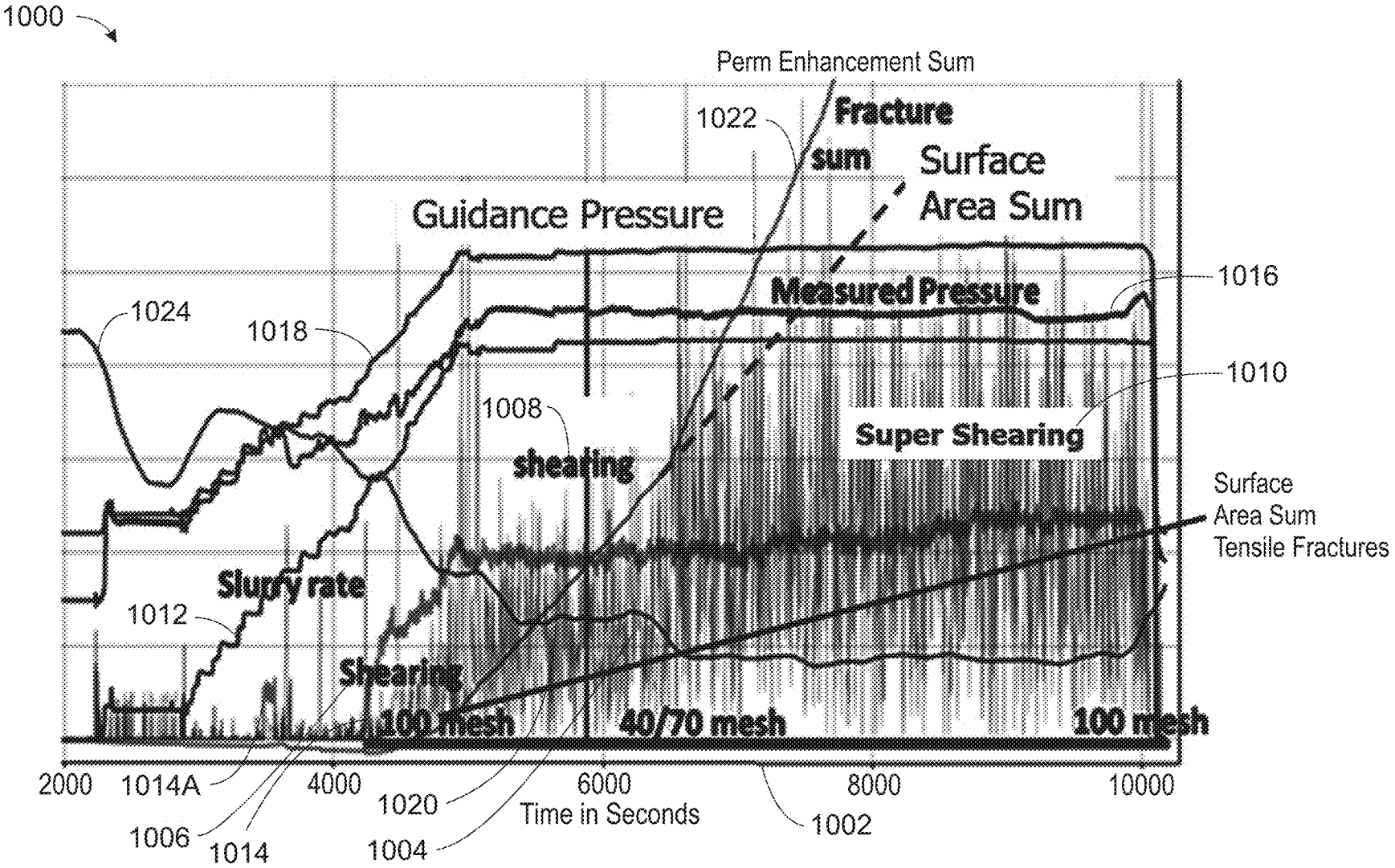
FIG. 10 is a plot over time for hydraulic fracturing of rock in a subterranean formation showing sum of surface area for shear fracturing, which is the sum of permeability enhancement for shear fracturing.

FIG. 10 is a plot 1000 over time 1002 (seconds) for hydraulic fracturing of rock in a subterranean formation. Block size (1004) may greatly increase shearing when block size is small. Block size can be scaled, for example, from 1 to 100 feet. Blocks greater than 30 feet per side may generally have low recovery and diffusion flow. Blocks smaller than 30 feet generally have high recovery and diffusion flow. The curve 1004 is an indicator of the rock block sizes resulting from shear fracturing. Large rock blocks (high values) might represent blocks greater than 30 feet on a side. Small rock blocks (low values) may represent rock blocks as small (e.g., analogous as Rubik's cubes). In some implementations, a block size curve 1024 on the real-time plot may be the inverse or proportional to the inverse of frequency of the fractures. The frequency value may be or related to, for example, average derivative pressure calculated over time. Other configurations are applicable. In general in some embodiments, for "block size" the more breaks per time interval, the smaller the rock in the rock breakage.

The shear fracturing includes an initial region 1006 of shear fracturing (beginning about the time of sand input), a subsequent region 1008 of increased shear fracturing that persists for about 2000 seconds, and a region 1010 of super shear fracturing that persists for about 4000 seconds. Curves depicted in the plot 1000 include fracing-fluid slurry rate 1012, fracing-fluid proppant concentration 1014, pressure 1016 measured at the wellhead of the wellbore through which the fracing fluid is applied, and a guidance pressure 1018. In this example, the proppant concentration 1014 is based on the density of the fracing fluid. The portion 1014A shows when acid was added to the fracing fluid. The guidance pressure 1018 are pressure values computed by equations or neural networks, or artificial intelligence for the rock type fractured with 100 mesh or finer sand. Guidance pressure is used to recommend treatment pressures. When measured pressure exceeds guidance pressure, such might indicate that sand is over filling fractures. When measured pressure is less than guidance pressure, such might indicate that fluid is leaking from the fractures too quickly to generate stress. A curve for the sum 1020 of shear fracture surface area is given. In the region 1010 of super shear fracturing, a branch of the sum 1022 of fracturing surface additionally includes an indication of enhanced permeability (also in square feet) due to the shear fracturing that may increase total hydrocarbon recovery and reduce well production declines from that well in the geological formation.

As mentioned, a block size 1024 curve is depicted. The block size 1024 generally decreases through the hydraulic fracturing. The block size may be defined as the relative sizes of rock blocks that are created by hydraulic fracturing. Small blocks generally fracture with greater fracture density and efficiency.

Block size may be inversely proportional to breakage frequency indicated by measured pressure and the aforementioned calculations via equations or neural networks. The more frequent the measured fracture breaks, the smaller the block size. There is generally increase in shear fracturing when block size decreases. Frac-fluid injection and proppant (sand) concentration may be additionally considered. What can make block size significant is that the number of pre-existing expulsion (micro) fractures may dominate hydraulic fracturing behavior. Block size may be correlative with and utilized to indicate the number of fractures and presence of shear fracturing or super shear fracturing. Block size also be calibrated to hydrocarbon production performance.

As mentioned, techniques are described in U.S. Pat. No. 10,711,604 to create more complex (shear) fractures and fewer simple (tensile) fractures by efficiently converting pressure to rock stress. Embodiments of the present techniques may improve on this earlier work by (1) creating a range of small through larger hydraulic fractures that are sand filled and connected to hydrocarbon-filled pores and small natural fractures where hydrocarbons move by diffusion (concentration gradient as well as by pressure gradient), and (2) focusing stress waves which alternately stress and de-stress rocks causing significant constructive shear waves of rock destruction. Once capillary fluid flow systems are connected to hydraulic fractures, better than expected production and recovery can result. In human circulatory systems, diffusion dominates in small blood vessels and Darcy flow dominates in larger blood vessels. In reservoirs, pores and natural expulsion fractures exhibit capillary flow and proppant packed hydraulic fracture have Darcy flow. Proppant sized by sieving may be utilized to systematically stress pores, natural micro fractures and laminations to provide proppant filled connections to producing oil and gas wells. Hydrocarbons trapped in tight matrix rocks may be released by breaking the rock into the small pieces. The fracture dilation, proppant filling, rock stressing and rock failure mechanisms may be further enhanced by "fluidizing" the rock mass. Fluidization may be caused by maintaining pore fluid pressure above overburden pressure to enhance rock destruction. This may be implemented by (1) increasing or dropping fluid pressure by filling or draining fluid surrounding rock, and (2) increasing pore pressure to slip rock laminae like disks on an air-hockey table.

The techniques may employ real-time (e.g., second-by-second) measures of pressure or delayed 15-30 seconds measures of pressure) to observe stress waves and maintain the forces of fracture dilation and closure in balance, as proppant slurry fills the fractures. The maintained pressure-rate balance that propagates stress waves which trigger (initiate) significant shear fracturing or the greater super shear fracturing can be triggered with small (~0.5 to 1.0 bpm) changes in fracing-fluid flow rate. Super shearing is a grade of greater shear fracturing. Geologic mechanical layers which exhibit stress associated with super shear fracturing can be in patterns that can be analyzed with Fourier transforms to characterize dominant frequencies at which rock destruction occurs. This knowledge may facilitate tuning of frac-fluid rates and proppant concentrations to increase fracture counts specific for different geology (block sizes).

Aspects may be for real-time control of fracturing, which facilitates fracture numbers and types to be observed as injection rates and proppant concentrations are adjusted. Embodiments may measure the natural harmonic frequency at which different geologic layers fracture with greater rock destruction. The number of fractures counted in each stage may utilized as a variable to select the better rock for completion and production.

Certain embodiments may fluidize rock and adjust proppant-fluid slurries to trigger the onset of super shear fracturing for each stage with the particular unique geo-mechanical layer(s) of each stage. Some implementations may generate laminated rock shear fracturing including super shear fracturing by changing fluid pressure up or down. Rocks surrounded by fluid may be stressed by higher fluid rates and de-stressed with lower rates. Stress patterns are developed to identify shear fracturing and super shear fracturing by the length of time (period) to initiate and propagate the fracturing.

Embodiments may utilize different sizes of proppant to invade and stress different sizes of natural pores and micro expulsion fractures to connect natural fluid diffusion networks to proppant-filled fractures that flow by Darcy (pressure drop) physics. Production rates may be predicted from stimulated reservoir volumes (SRV's) that are shear fractured and filled with 40/70, 100, and 200 mesh or other small proppants. Different proppant sizes may effectively connect different-sized capillary flow networks to different-sized hydraulic fractures packed with proppant.

The discussion now turns to a rock stress curve. Pressure measurements may respond to fracing-fluid slurry rate, fracing-fluid proppant concentration, fracing fluids and rock stress changes. This can be reduced, through calculation, to a rock stress curve. By calculating the frequency spectrum (via fast Fourier transform or FFT) of this rock stress curve, the dominant frequencies of the rock breakage can be monitored and recorded. Depending upon the slurry paths through the formation (reservoir) bedding planes, both vertical (or near vertical) and horizontal (or near horizontal), the shale (or low permeability rock) may break at measurable discrete frequencies that can be monitored from the calculated rock stress curve. Analysis of these frequencies recorded in the frequency spectrum may provide a pattern (e.g., a unique pattern) that defines how the rock is breaking. Utilizing pattern recognition, the frequency data may be categorized to determine the homogeneity and/or heterogeneity of the rock lamination that is fracturing, as well as possible bed thicknesses and the position of beds invaded by slurry. These patterns can be input to a database and via neural net and machine learning correlated with production data to determine the level of productivity, via stimulated reservoir volume, of each frequency pattern. Information analyzed may include at least geographic location, basin, stratigraphic interval, rock character, rock type, depth, completion fluids, proppant types and amounts, rates of injection, timing, delays, and patterns of fluid, proppant and chemical injection.

The correlation of frequency patterns, fracture types, fracture size, fracture number and rock block size, with other geologic and geo-mechanical data (via the above-mentioned analyses) may yield design curves (slurry rate, proppant concentration, block size, etc.) to be employed for optimum stimulated reservoir volumes. This, in turn, may increase or give a beneficial production profile of each stage of each well, and also provides parameters to compute beneficial well spacing for each pad. However, because design curves may be based on statistical analysis, the techniques can be augmented by utilizing the feedback information from real-time data collection and analysis. Real-time feedback from reservoir rock stress response, which may be determined or calculated, can provided recommended or suggested real-time modifications to the design curves to evaluate the degree of success of curve modifications. This continuous feedback loop, while the stage is being fractured, may yield beneficial completion settings available for the current well/stage location and rock properties.

An embodiment is a method of hydraulic fracturing a subterranean formation, including: injecting frac fluid comprising slurry through a wellbore into the subterranean formation; measuring pressure associated with the hydraulic fracturing; adjusting slurry rate of the frac fluid to promote shear fracturing of rock in the subterranean formation, wherein the slurry rate comprises flow rate of the frac fluid with the proppant; and developing, via a processor, a rock stress curve correlative with the pressure, the slurry rate, a concentration of the proppant in the fracing fluid, and observed stress of the rock. The stress in the rock may be indicated by the indicator of the amount of shear fracturing e.g., by cumulative shear fracture count curve or shear-fracture surface-area curves that are generated in real time or substantially real time.

The method may include calculating (e.g., by Fourier transform, FFT, etc.) via the processor a frequency spectrum of the rock stress curve, wherein dominant frequencies of the frequency spectrum are indicative of breakage of layers of the rock. The method may include monitoring and recording the dominant frequencies. The rock may break at discrete frequencies indicated via a frequency spectrum of the rock stress curve, wherein the discrete frequencies are measurable. The discrete frequencies may be correlative with a direction of a flow path of the fracing fluid through a bedding plane, or other plane of weakness in the subterranean formation. A pattern of the discrete frequencies on the frequency spectrum may be indicative of behavior of breaking of the rock comprising the shear fracturing. The method may include categorizing frequency data of the discrete frequencies via pattern recognition to determine homogeneity and heterogeneity or the number of layers being fractured.

The method may include categorizing frequency data of the discrete frequencies via pattern recognition to indicate a bed thickness of the rock and a number of beds of the rock invaded by the fracing fluid. In particular implementations, the method may include to characterize the stages for production forecasting from the relative amounts of proppant pumped in each stage or from the frequency patterns that describe each stage, or base on other factor. In the example of 200 mesh proppant, the stimulated 200 mesh volume (SRV) may be calculated based on the amount 200 mesh proppant in certain instances. SRV's can be computed for each of the proppants placed. Reservoir engineers may desire the SRV's from each stage.

Figure 11:
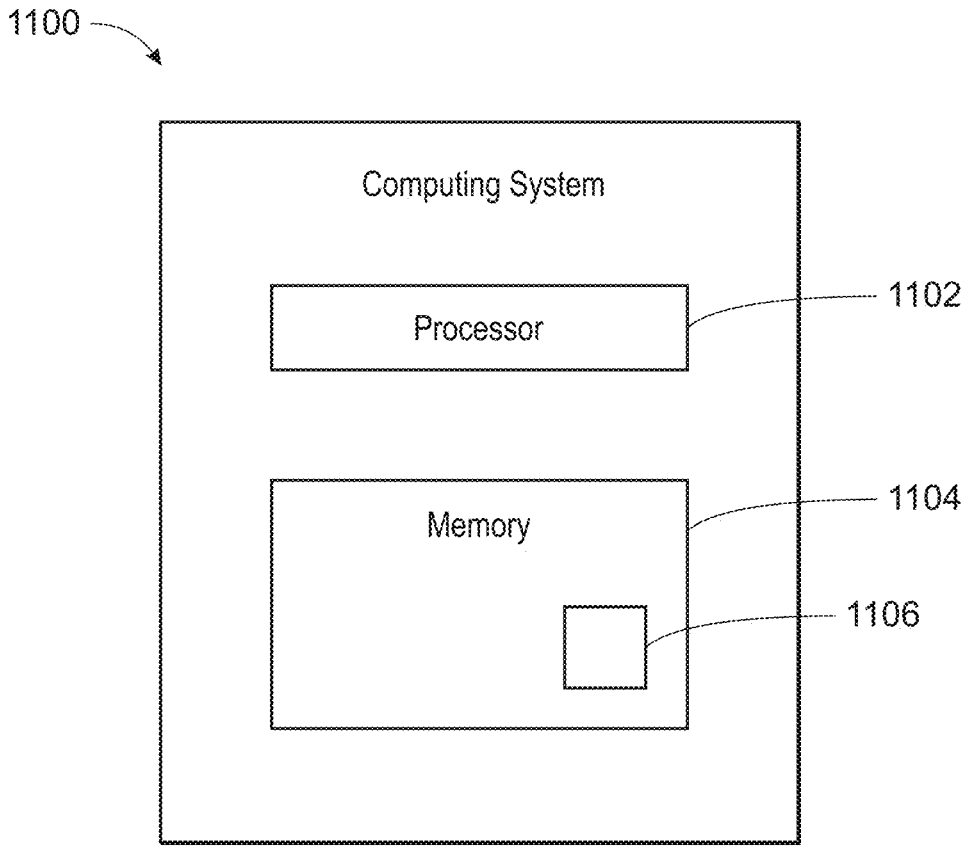
FIG. 11 is diagram of a computing system having a processor and memory storing code executed by the processor to receive an indicator of the amount of shear fracturing during hydraulic fracturing.

FIG. 11 is a computing system 1100 having a processor 1102 and memory 1104 storing code 1106 (e.g., logic, instructions, etc.) executed by the processor 1102. The computing system 1100 may be single computing device or a computer, a server, a desktop, a laptop, multiple computing devices or nodes, a distributed computing system, control system, and the like. The computing system 1100 may be local (at the wellbore or remote from the wellbore. Indeed, the computing system may represent multiple computing systems or devices across separate geographical locations. The computing system may be a component of a control system (e.g., 116 in FIG. 1). The processor 102 may be one or more processors, and may have one or more cores. The hardware processor(s) 102 may include a microprocessor, a central processing unit (CPU), graphic processing unit (GPU), or other circuitry. The memory 1104 may include volatile memory (e.g., cache, random access memory or RAM, etc.), nonvolatile memory (e.g., hard drive, solid-state drive, read-only memory or ROM, etc.), and firmware, and the like.

In operation, the computing system 1100 may receive measured pressure data originating from a pressure sensor measuring wellhead or bottom hole pressure and also receive data from other sensors and controllers. The code 1106 may include an analyzer or analysis logic and a neural network when executed that directs the processor 1102 to receive, determine, calculate, or utilize an indicator of the amount of shear fracturing, a guidance pressure, and a rock stress curve or other curves. The code 1106 may include an adjuster or controller which may give instructions when executed that direct the processor 1102 to specify a set point or adjust an operating parameter of the hydraulic fracturing system. The computing system 1100 is unconventional, for example, in that the computer can utilize the indicator of shear fracturing and also specify adjustments of the hydraulic fracturing to increase or advance shear fracturing. In this context, the computer is innovative with respective to accuracy and speed (real time). In addition, the technology of hydraulic fracturing is improved. Further, this innovative computing system results in increased production of hydrocarbon (e.g., crude oil and natural gas) from a well.

Figure 12:
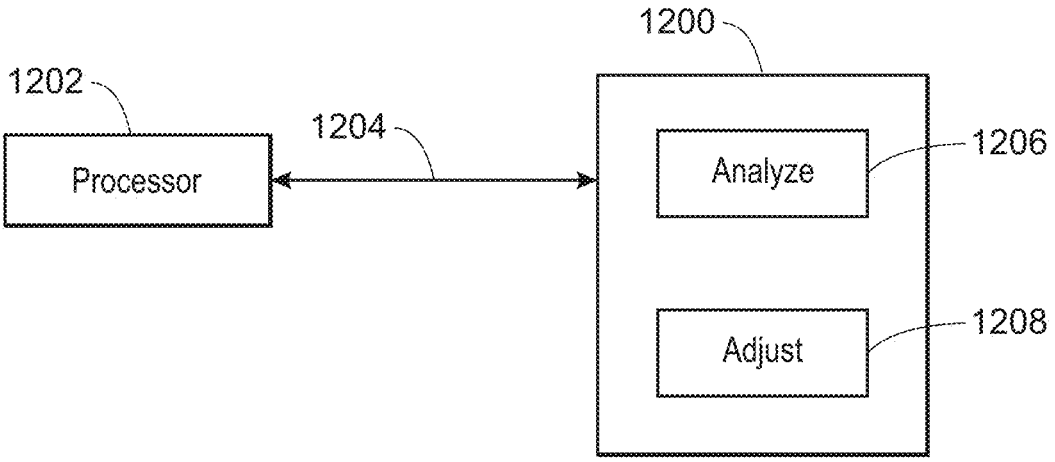
FIG. 12 is a block diagram of a tangible, non-transitory, computer-readable medium that can facilitate analysis and control of hydraulic fracturing.

FIG. 12 is a block diagram depicting a tangible, non-transitory, computer (machine) readable medium 1200 to facilitate analysis and control of hydraulic fracturing. The computer-readable medium 1200 may be accessed by a processor 1202 over a computer interconnect 1204. The processor 1202 may be a controller, a control system processor, a controller processor, a computing system processor, a server processor, a compute-node processor, a workstation processor, a distributed-computing system processor, a remote computing device processor, or other processor. The tangible, non-transitory computer-readable medium 1200 may include executable instructions or code to direct the processor 1202 to perform the operations of the techniques described herein, such as to receive, determine, calculate, or utilize an indicator of the amount of shear fracturing, a guidance pressure, and a rock stress curve or other curves, and in some examples, adjust a controller or specify a set point for operation of a hydraulic fracturing system. The various executed code components discussed herein may be stored on the tangible, non-transitory computer-readable medium 1200, as indicated in FIG. 12. For example, an analysis code 1206 may include executable instructions to direct the processor 1202 to as to receive, determine, calculate, or utilize an indicator of the amount of shear fracturing, a guidance pressure, and a rock stress curve or other curves. Adjust code 1208 may include executable instructions to direct the processor to specify a set point or adjust an operating parameter of the hydraulic fracturing system. It should be understood that any number of additional executable code components not shown in FIG. 12 may be included within the tangible non-transitory computer-readable medium 1200 depending on the application.

An aspect of the present techniques relates to a hydraulic fracturing system including a pump(s) to inject fracing fluids and a blender(s) to vary proppants and fluid viscosities with pump rates through a wellbore into a geological formation for hydraulic fracturing of the geological formation. The system includes a pressure sensor to measure pressure associated with the hydraulic fracturing. The pressure sensor or pressure gauge may be at the wellhead of the wellbore or lowered downhole into the wellbore, or be two pressure sensors with a pressure sensor disposed at each location, respectively. Again, the pressure sensors may include pressure gauges. Another aspect of the present techniques may relate to computer-facilitated or computer-guided implementation of real-time shear fracturing including analyses with neural networks, machine learning, artificial intelligence, or computer code with equations, or any combinations thereof.

The shear fracturing may generally be high surface-area shear fracturing. Complex shear fractures (or shear fractures) may be defined as fractures that are not simple planar tensile fractures. A planar fracture may be labeled as a tensile fracture or a planar tensile fracture, and the like. Shear fractures generally collectively have high surface area relative to a planar tensile fracture system. Shear fractures may be small shear fractures that collectively give high surface area including greater surface area than a single planar fracture. Thus, again, complex shear fracturing may be characterized as high surface-area shear fracturing. Complex shear fracturing may give a large number of shear fractures or fracture branches (e.g., in a localized volume) and in which the shear fractures can be very small. While the shear fractures may be referred to as complex shear fractures due to their formation via complex shear fracturing, the shear fractures may include simple shear fractures. Moreover, while complex shear fracturing may be referred to as giving high surface area, an individual or single shear fracture or branch may have less surface area than a single planar tensile fracture. However, a shear fracture may be characterized as dendritic and with many branches. Whether such a fracture formation is viewed as a shear fracture or shear fractures, such a branching shear fracture or shear fracture event may originate with (or be associated with) a stress event such as the relieving of accumulated stress. Hydraulic fracturing produces both tensile and shear fractures—both may be measured and counted to determine fracture efficiency. Indeed, hydraulic fracturing can include both shear fracturing and tensile fracturing. The presence of shear fracturing can be determined. The presence of tensile fracturing can be determined. Permeability or effective permeability of the fractured formation may be correlative (e.g., directly proportional) with the dendritic complexity and abundancy of the shear fracturing or shear fractures including formed shear micro-fractures.

An embodiment is a method of hydraulic fracturing a subterranean formation including to count number and types of fractures created in real time. The method includes injecting a frac slurry comprising frac fluid and proppant through a wellbore into the subterranean formation, and hydraulic fracturing the subterranean formation with the frac slurry, the hydraulic fracturing including shear fracturing rock in the subterranean formation. The method includes observing change in fracture counts with changes in the proppant size, proppant concentration in the frac slurry, and block size in the subterranean formation being hydraulically fractured. The method includes measuring pressure associated with the hydraulic fracturing, receiving an indicator of an amount of the shear fracturing occurring per unit time, and adjusting operating parameters of the hydraulic fracturing in real time to increase the amount of shear fracturing occurring per unit time. The adjusting of the operating parameters may involve observing real-time responses of numbers of shear fractures over time to achieve shear fracturing and to perform goal seeking to give super shear fracturing, wherein the operating parameters comprise fluid viscosity of the frac fluid, flow rate of the frac slurry, block size and the proppant concentration. The super shear fracturing may involve selection of rock layers in stages, so that successfully super sheared zones from one stage can have processes repeated to achieve successful shear fracturing in other stages with similar or different rock.

An amount of hydraulic fracturing may be a fracture count that is a number of shear and tensile fractures. An amount of hydraulic fracturing may be surface area of shear and tensile fracturing, where the surface area gives hydrocarbon production by concentration gradients or diffusion, and that leads to both higher wells rates and hydrocarbon recoveries. An amount of hydraulic fracturing is permeability of super shear fractures, which generates higher production rates from pressure drops in fractures generated in the shear fracturing including super shear fracturing. The shear fracturing may include an amount of super shear fracturing that is enhanced permeability of the geological formation due to the super shear fracturing that will give increased total diffusion recovery of hydrocarbon from the geological formation. The method may include triggering stress waves in the rock with the frac slurry, wherein the stress waves are self-propagating and include constructively interfering stress waves.

The operating parameters adjusted in real time include flow rate of the frac slurry. Adjusting the flow rate may be increasing the flow rate, wherein increasing the flow rate increases the pressure and increases stress in the rock. Adjusting the flow rate may be decreasing the flow rate, wherein decreasing the flow rate decreases the pressure and reduces stress in the rock. Adjusting the flow rate may include adjusting the flow rate in response to stress patterns in the rock to seek and create resonant frequency of fracturing. Adjusting the flow rate may generate energy pulses so that the rock is alternately stressed and de-stressed in constructive stress waves that are additive to destruction the rock comprising the shear fracturing. Adjusting the flow rate may give failure in the rock contributing to the shear fracturing. Adjusting the flow rate may include adjusting to a flow rate at which the laminations of the rock are fluidized with pressure that penetrates beds at pressures below those required to support weight of overlying rock. The pressure supporting the weight of the overlying rock may facilitate the frac fluid penetration of bedding of the rock, sufficient to flex the rock to cause beds to slip analogous to a folded card deck. The method may include maintaining the pressure below a threshold such that planar tensile fracturing does not occur.

The operating parameters adjusted may include concentration of the proppant in the frac fluid. Adjusting operating parameters may include adjusting an amount of the proppant placed in shear fractures generated in the shear fracturing, wherein the proppant comprises sand or other material of a size to enter small fractures and control leak-off and increase stress. The method may include fluidizing the rock which may involve the pressure not exceeding weight of overlying overburden rock, because rock planes of weakness take fluid below the overburden pressure.

Adjusting the operating parameters may generate stress waves in the rock. In this context, adjusting the operating parameters may involve goal-seeking for the stress waves to propagate at resonant stress frequency of the rock. Adjusting the operating parameters may initiate stress waves in the rock, and wherein the stress waves are self-propagating after initiation. Measuring the pressure may involve real time measurements of the pressure to observe stress waves in the rock. In this context, the stress waves may have a frequency equal to the resonant stress frequency, and wherein the resonant stress frequency comprises a natural harmonic frequency at which the rock will vibrate with the stress waves. The proppant in the frac fluid may facilitate transfer of pressure of the frac fluid to the rock as stress.

The method may include specifying a proppant size of the proppant to promote shear fracturing in fractures of different size. In this context, specifying the size comprises specifying the proppant size such that the proppant as sand enters fractures in the subterranean formation having a fracture width larger than the sand grains as measured by passing the sand through sieves, the fractures including sand-filled shear fractures coupled to a natural diffusion flow fracture network of a hydrocarbon reservoir in the subterranean formation.

The indicator may be received during the hydraulic fracturing. The indicator may be correlative with volume of proppant placed in shear fractures generated in the shear fracturing.

The shear fractures generated in the shear fracturing may connect to pores and natural fractures in the subterranean formation where hydrocarbon moves by diffusion in natural fractures, wherein the natural fractures include natural expulsion fractures that exhibit capillary flow of hydrocarbon. The method include specifying size of the proppant such that proppant flows into the shear fractures and the natural fractures, wherein the natural fractures have different sizes, and wherein the size of the proppant comprises 100 mesh or smaller sizes that can enter into the shear fractures and natural fractures. The proppant facilitates connecting of the shear fractures with the natural fractures.

Lastly, embodiments of the present techniques may include hydraulic fracturing a subterranean formation including determining the amount of complex shear fracturing that is occurring. The hydraulic fracturing involves injecting a frac slurry having frac fluid through a wellbore into the subterranean formation, hydraulic fracturing the subterranean formation with the frac slurry, and observing change in the amount of hydraulic fracturing. The hydraulic fracturing includes complex shear fracturing the rock in the subterranean formation. Operating parameters of the hydraulic fracturing may be adjusted in real time to increase the amount of complex fracturing occurring per unit time. Such adjusting may be based on resonant frequency at which the rock fractures. The fracture surface area may be considered. The complex shear fracturing may assist with diffusion production from areas of high hydrocarbon concentrations (reservoir source rocks) to areas with lower hydrocarbon concentrations (water-filled hydraulic fractures).

A number of implementations have been described. Nevertheless, it will be understood that various modifications may be made without departing from the spirit and scope of the disclosure.

What is claimed is:

1. A method comprising:

receiving values of pressure as measured, the pressure associated with hydraulic fracturing of a subterranean formation with frac fluid injected through a wellbore into the subterranean formation, the hydraulic fracturing comprising complex shear fracturing of the subterranean formation;

determining an indicator of the complex shear fracturing occurring per unit time, wherein the indicator is based on a Fourier transform of at least one of the pressure, pressure derivative, or pressure patterns; and specifying adjusting an operating parameter of the hydraulic fracturing to increase the complex shear fracturing, wherein the operating parameter comprises flow rate of the frac fluid, fluid viscosity of the frac fluid, or proppant concentration in the frac fluid, or any combinations thereof, and wherein the hydraulic fracturing comprises adjusting the operating parameter as specified.

2. The method of claim 1, wherein the complex shear fracturing comprises connecting complex shear fractures generated in the complex shear fracturing to natural fractures in the subterranean formation.

3. The method of claim 1, wherein the indicator is correlative with surface area of complex shear fractures generated in the complex shear fracturing, wherein the pressure comprises wellhead pressure, downhole pressure, or a calculated pressure, or any combinations thereof, and wherein the complex shear fracturing gives increased production rate of hydrocarbon from the subterranean formation through the wellbore and gives increased hydrocarbon recovery from the subterranean formation through the wellbore.

4. The method of claim 1, wherein the pressure is measured via a pressure sensor at a wellhead of the wellbore or via a pressure sensor downhole in the wellbore, or a combination thereof, wherein the operating parameter comprises the flow rate of the frac fluid as injected, and wherein complex shear fractures generated in the complex shear fracturing connect to natural fractures that exhibit capillary or diffusion flow of hydrocarbon.

5. The method of claim 1, wherein the indicator is based on stress patterns in rock in the subterranean formation observed via the pressure as measured.

6. A method, comprising:

receiving values of pressure associated with hydraulic fracturing a subterranean formation with frac fluid pumped through a wellbore into the subterranean formation, the hydraulic fracturing comprising complex shear fracturing rock in the subterranean formation;

determining an indicator of an amount of the complex shear fracturing, wherein the indicator is based on a Fourier transform of at least one of the pressure, pressure derivative, or pressure patterns; and specifying adjusting an operating parameter of the hydraulic fracturing to increase the amount of the complex shear fracturing, wherein the operating parameter comprises flow rate of the frac fluid, fluid viscosity of the frac fluid, or proppant concentration in the frac fluid, or any combinations thereof, and wherein the hydraulic fracturing comprises adjusting the operating parameter as specified.

7. The method of claim 6, wherein the complex shear fracturing comprises connecting to natural fractures in the subterranean formation.

8. The method of claim 6, wherein the indicator of the amount of the complex shear fracturing comprises an indicator of the amount of the complex shear fracturing occurring per unit time.

9. The method of claim 6, wherein the hydraulic fracturing triggers stress waves in the rock with the frac fluid, wherein the stress waves are self-propagating and comprise constructively interfering stress waves that contribute to the complex shear fracturing, and wherein the operating parameter comprises the flow rate of the frac fluid as pumped.

10. The method of claim 6, wherein proppant in the frac fluid facilitates transfer of pressure of the frac fluid to the rock as stress, and wherein the complex shear fracturing gives complex shear fractures that couple to existing natural fractures in the subterranean formation, thereby resulting in increased diffusion recovery of hydrocarbon from the subterranean formation through the wellbore.

11. The method of claim 6, wherein the complex shear fracturing connects to natural fractures in the subterranean formation.

12. The method of claim 6, wherein the pressure is measured in real time, and wherein receiving the values of the pressure comprises receiving in real time the values of the pressure as measured.

13. The method of claim 6, wherein the indicator of the amount of the complex shear fracturing is correlative with surface area of complex shear fractures generated in the complex shear fracturing.

14. The method of claim 6, wherein the amount of the complex shear fracturing comprises surface area of complex shear fractures generated in the complex shear fracturing, wherein the pressure is measured at a wellhead associated with the wellbore or downhole in the wellbore, or a combination thereof, and wherein adjusting the operating parameter as specified gives failure in the rock contributing to the complex shear fracturing.

15. A hydraulic fracturing system comprising:

a control system to:

receive measured pressure data of pressure associated with hydraulic fracturing of a subterranean formation in Earth crust with a frac fluid injected by the hydraulic fracturing system through a wellbore into the subterranean formation, the hydraulic fracturing comprising complex shear fracturing of the subterranean formation;

determine an indicator of the complex shear fracturing occurring per unit time, wherein the indicator is based on a Fourier transform of at least one of the pressure, pressure derivative, or pressure patterns; and adjust an operating parameter of the hydraulic fracturing to increase the complex shear fracturing, wherein the operating parameter comprises flow rate of the frac fluid, fluid viscosity of the frac fluid, or proppant concentration in the frac fluid, or any combinations thereof.

16. The hydraulic fracturing system of claim 15, wherein the indicator is correlative with surface area of complex shear fractures generated in the complex shear fracturing, and wherein to adjust the operating parameter comprises specifying a set point of the operating parameter.

17. The hydraulic fracturing system of claim 15, wherein to adjust the operating parameter comprises adjusting the operating parameter of the hydraulic fracturing in real time, and wherein the hydraulic fracturing generates complex shear fractures and tensile fractures.

18. The hydraulic fracturing system of claim 15, wherein the indicator is correlative with surface area of complex shear fractures generated in the complex shear fracturing, wherein the measured pressure data is generated via measuring pressure at a wellhead or downhole in the wellbore, or a combination thereof.

19. A method, comprising:

receiving values of pressure associated with hydraulic fracturing a subterranean formation with frac fluid pumped through a wellbore into the subterranean formation, the hydraulic fracturing comprising complex shear fracturing rock in the subterranean formation;

receiving an indicator of an amount of the complex shear fracturing; and specifying adjusting an operating parameter of the hydraulic fracturing to increase the amount of the complex shear fracturing, wherein the operating parameter comprises flow rate of the frac fluid, fluid viscosity of the frac fluid, or proppant concentration in the frac fluid, or any combinations thereof, wherein the hydraulic fracturing comprises adjusting the operating parameter as specified, wherein the hydraulic fracturing generates stress waves in the rock, and wherein the method comprises goal seeking via specifying adjusting the operating parameter for the stress waves to propagate at resonant stress frequency of the rock.

20. A hydraulic fracturing system comprising:

a computing device configured to:

receive measured pressure data associated with hydraulic fracturing of a subterranean formation in Earth crust with a frac fluid injected through a wellbore into the subterranean formation, the hydraulic fracturing comprising complex shear fracturing of the subterranean formation;

determine an indicator of the complex shear fracturing occurring per unit time;

adjust an operating parameter of the hydraulic fracturing to increase the complex shear fracturing, wherein the operating parameter comprises flow rate of the frac fluid, fluid viscosity of the frac fluid, or proppant concentration in the frac fluid, or any combinations thereof;

perform goal seeking via adjusting the operating parameter to increase the complex shear fracturing generates stress waves in rock of the subterranean formation; and interpret the measured pressure data to evaluate the stress waves, wherein a goal of the goal seeking is the stress waves propagating at resonant stress frequency of the rock.

* * * * *